United States Patent [19]

Shaw et al.

[11] 4,444,542

[45] Apr. 24, 1984

[54] VEHICLE WITH DOUBLE BOOMS

[76] Inventors: Douglas A. Shaw, 323 NW. Hill; Stephen D. Barclay, 20636 Nandi Ct., both of Bend, Oreg. 97701

[21] Appl. No.: 266,492

[22] Filed: May 22, 1981

[51] Int. Cl.[3] ..... E02F 3/32

[52] U.S. Cl. ..... 414/694; 414/722; 212/233; 37/103

[58] Field of Search ..... 212/194, 233; 180/8.6, 180/8.7; 414/687, 694, 722; 299/31, 33; 37/103

[56] References Cited

U.S. PATENT DOCUMENTS

| | | | |
|---|---|---|---|
| 2,068,397 | 1/1937 | Chapman | 212/233 X |
| 2,799,249 | 7/1957 | Lear | 212/233 X |
| 3,771,610 | 11/1973 | Leyrat | 173/46 |
| 3,842,610 | 10/1974 | Willis et al. | 61/63 |
| 3,855,807 | 12/1974 | Grable | 414/694 X |
| 3,909,962 | 10/1975 | Guinot | 414/694 X |
| 4,098,538 | 7/1978 | Hilton | 299/33 |
| 4,113,316 | 9/1978 | Phillips et al. | 299/31 |
| 4,202,423 | 5/1980 | Soto | 180/8.6 |

*Primary Examiner*—Robert J. Spar
*Assistant Examiner*—Terrance L. Siemens
*Attorney, Agent, or Firm*—Kolisch, Hartwell, Dickinson & Anderson

[57] ABSTRACT

An earth-working vehicle with a pair of articulated booms mounted side-by-side adjacent the forward end of a turntable in the vehicle. The booms pivot in parallel vertical planes that parallel the longitudinal axis of the turntable. An operator's station is located at the forward end of the turntable, on the opposite side of the turntable from the booms.

3 Claims, 3 Drawing Figures

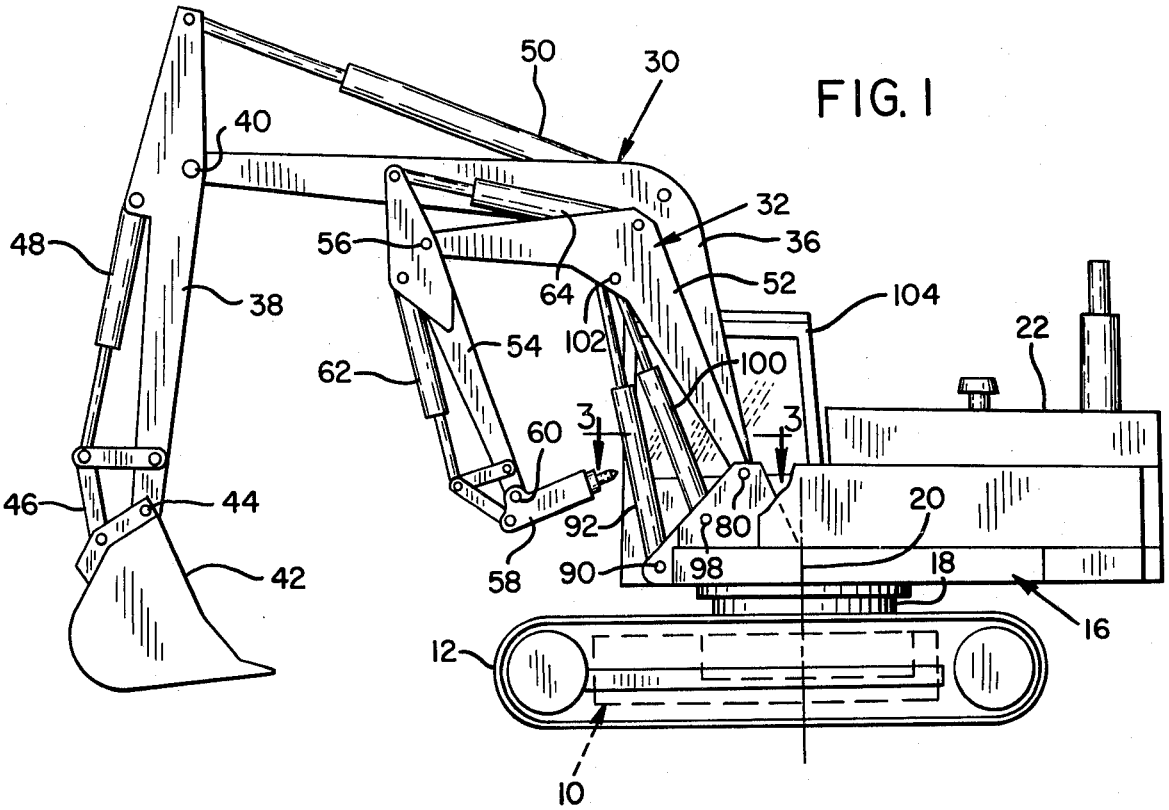
FIG. 1
FIG. 2
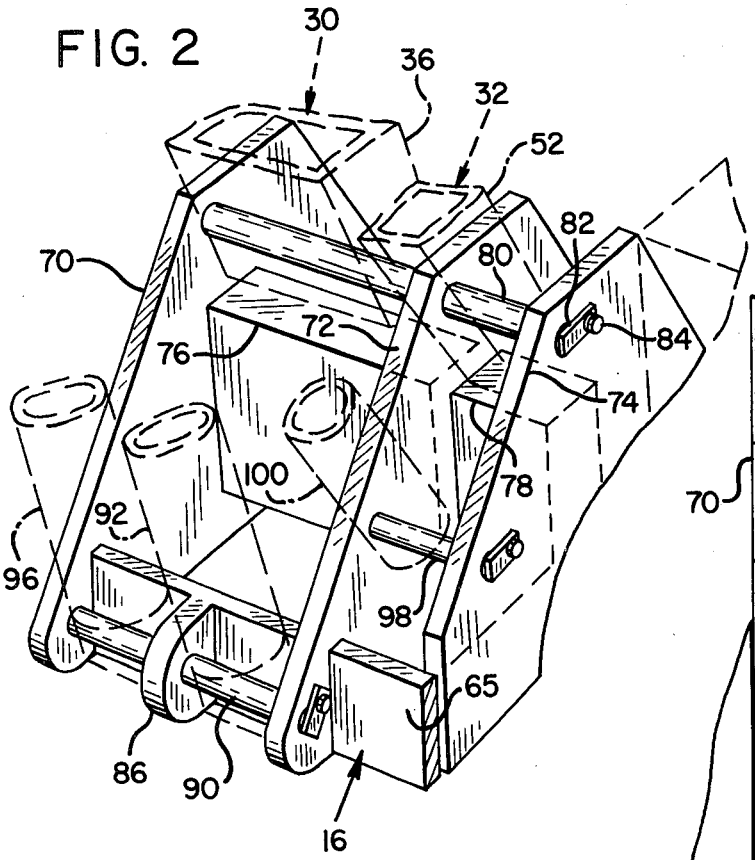
FIG. 3
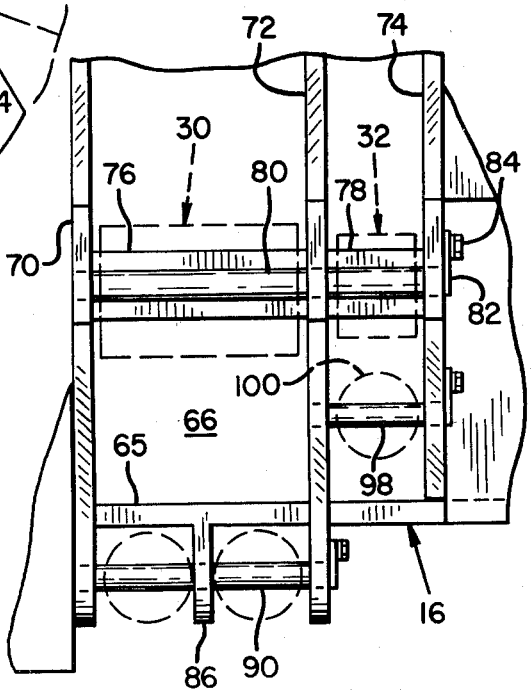

VEHICLE WITH DOUBLE BOOMS

BACKGROUND AND SUMMARY

This invention relates to earth-working vehicles, and more particularly to a vehicle of this description having particular utility in such projects as excavating, road repair, the laying of underground conduit, etc.

Known forms of equipment utilized in performing operations such as those discussed above include what is sometimes referred to as a back hoe taking the form of an articulated boom having a bucket mounted on a tip section of the boom, such back hoe being supported on the end of a vehicle such as a tractor. When equipment of this description is used in a job such as preparing a trench through a paved area, circumstances may arise that would dictate the use of an attachment such as a hydro-hammer, grapple, or compactor, rather than a bucket. This necessitates temporarily halting the excavation job, and the removal of the bucket from the boom with replacement of the bucket with the attachment desired. The procedure is time consuming and unproductive. Equipment is also known which might have, for instance, a back hoe on one end of the vehicle, and a scoop bucket at the other end. However, the position of the operator and the controls that he utilizes in operating the back hoe are not conveniently located for operation of the working implement at the opposite end of the vehicle.

Generally, therefore, it is an object of this invention to provide an improved earth-working vehicle, having markedly improved versatility in performing a job such as an excavation requiring periodically the use of an attachment other than the usual bucket.

A related object to provide such a vehicle where the position of the operator and the controls that he uses is the same, whether using a bucket, or another form of working mechanism.

Following the invention, the operator has good visibility of the area being worked, whether actually excavating the ground with a bucket or loosening up material with a mechanism such as a hydro-hammer.

According to a preferred embodiment of the invention, a vehicle as contemplated herein comprises a frame supported for movement over the ground, as by crawler tracks. Supported on this frame is a rotatable turntable. Mounted adjacent one end of the turntable on the turntable frame, and adjacent one side of the turntable, are a pair of articulated booms, each comprising base and tip sections constrained to movement in vertical parallel planes. Mounted adjacent the same end of the turntable, on the opposite side of the turntable from the boom, are an operator's station and controls. The respective booms may be equipped with different working instrumentalities, such as a bucket, and a hydro-hammer or a compactor.

With the organization described, operator convenience in terms of visibility, and the facility with which a boom may be operated, is substantially the same, irrespective of which boom is being put to use. The booms are prevented from colliding, as they move together with turning movement of the turntable, and are constrained to movement in the parallel planes with respect to the turntable frame.

Weight distribution on the turntable may be essentially the same as where a single boom is provided, since when one boom is not in use, it may be folded back against the turntable and in such a position offers insignificant impairment to weight distribution. Base sections of the booms may be conveniently mounted using a portion of the turntable frame, with enforcement of such frame provided to accommodate mounting of one boom providing the enforcement accommodating mounting of the other.

These and other objects and advantages are attained by the invention, which is described hereinbelow in conjunction with the accompanying drawings, wherein:

DESCRIPTION OF THE DRAWINGS

FIG. 1 is a side elevation view of a vehicle with multiple booms as contemplated herein;

FIG. 2 is a perspective view, on an enlarged scale, illustrating the mounting for base sections in the booms, and FIG. 3 is a view taken generally along the line 3—3 in FIG. 1, also on a larger scale than the scale of FIG. 1.

DETAILED DESCRIPTION OF A PREFERRED EMBODIMENT OF THE INVENTION

Referring now to the drawings, the vehicle illustrated comprises an undercarriage or frame 10, and mounted on either side of this undercarriage, opposed crawler track assemblies 12. Rotatably supported over the undercarriage 10, through turntable support mechanism 18, is an elongate turntable 16. Turntable support mechanism 18 provides for rotation of the turntable about a vertical axis, shown at 20. Powering the vehicle is the usual engine housed within engine housing 22, the engine and engine housing being supported on what is referred to herein as the rear end of the turntable. The construction of turntable support mechanism 18 and the mounting of the crawler track assembly on either side of the undercarriage follows conventional practice, in that powder may be transferred from the engine to drive mechanism for driving the crawler tracks, and power is additonally employed to make turning adjustments in the position of the turntable relative to the undercarriage.

Shown at 30 and 32 are a pair of articulated booms. These are mounted on the frame of the turntable adjacent the forward end and to one side of the longitudinal axis of the turntable. The two booms may be of similar construction, although one boom, normally employed in the mounting of a bucket, exemplified by boom 30 ordinarily has a larger size than the other boom, employed in mounting an attachment such as a hammer or compacter, exemplified by boom 32.

Considering specifically boom 30, such has a base section 36, the bottom end of this base section 36 being pivotally mounted on the turntable, by means more specifically discussed below. The tip section or dipper for the boom is shown at 38. The tip section is pivotally mounted on the base section by pivot means 40.

Bucket 42 on boom 30 is pivotally mounted on the end of tip section 38 by pivot means 44. Pivoted linkage 46, actuated by extension and contraction of a ram 48, shifts the position of the bucket. The angular position of the tip section with respect to the base section is adjusted by extension and contraction of ram 50.

Boom 32, like boom 30, has a base section 52, pivoted tip section 54 pivoted to the base section at 56. The bottom end of the base section is pivotally mounted on the turntable by means more specifically described below. A hydro-hammer, shown at 58, is pivotally supported on the end of the tip section by pivot means 60.

Ram 62 is actuated to shift the position of the hydro-hammer. Ram 64 is actuated to change the relative position of the base and tip sections in the boom.

Referring now more specifically in FIGS. 2 and 3, fixed to the frame of the turntable, as by securing them to beam 65 and an enforcing plate 66 in the frame, are three upstanding laterally spaced brackets or plates 70, 72 and 74. Plate 72 is laterally spaced, in a direction extending to the right in FIG. 3, from plate 70, and plate 74 is laterally spaced in the same direction from plate 72. Extending between the plates, and secured to the plates as well as enforcing plate 65, serving to add rigidity to the structure, are box members 76, 78.

An elongate pin 80, extending through accommodating bores provided adjacent upper extremities of the various plates, spans plates 70, 72 and 74. The pin is secured in place as by fastening retainer 82 which is integral with one end of the pin, to one of the plates, using fastener 84. Boom 30 is provided with a bearing adjacent its bottom end which fits over the portion of pin 80 spanning plates 70, 72. In this way, the boom is mounted for swinging movement about a horizontal axis extending transversely of the longitudinal axis of the turntable, with the boom, therefore, having pivotal movement confined to movement in a vertical plane normal to this axis. With the pivot axis provided by pivot means 40 paralleling the pivot axis provided by pin 80, movement of the tip section of the boom relative to the base section is in this same plane.

The portion of pin 80 spanning plates 72, 74 provides a pivot mounting for the bottom end of base section 52 of boom 32. Specifically, a bearing is provided adjacent the bottom of this base section which receives a portion of pin 80. The pivot mounting provides for pivotal movement of the smaller boom in a vertical plane which parallels the plane discussed in connection with the larger boom. With the pin providing a pivot mounting for both booms, the two booms pivot about a common axis. The pivot axis provided by pivot 56 parallels the pivot axis provided for the base section, and thus the tip of the smaller boom moves in the plane in which the base section of the boom moves.

Shown at 86 in a lug joined to the frame of the turntable. A pin extending between plates 70, 72 and through lug 86, shown at 90, provides a pivot mounting for the cylinder ends of rams 92, 96, extending from the turntable frame to base section 36 of boom 30. Powered movement of the base section in boom 30 is produced by extension and contraction of these rams.

A pin 98 extending between plate 72 and plate 74 provides a pivot mounting for the cylinder end of a ram 100 which has its rod end pivotally connected at 102 to base section 52 of boom 32. Ram 100 provides a power-operated means for adjusting the position of the base section of boom 32.

Mounted on the turntable frame, also at the forward end of the frame, but on the other side of the longitudinal axis of the turntable from where the booms are located, is an operator's cab 104 enclosing a space which includes a seat or operator's station. The usual controls for operating the vehicle and the various booms are provided in a region in front of the operator's station within the cab, or near the left side of the cab as such is shown in FIG. 1.

It will be noted, in connection with the organization described, that with boom 30 extended and in a ground-working condition, and with boom 32 collapsed and folded back adjacent the turntable, the operator of the vehicle has substantially unimpaired visibility of the region being worked by the bucket mounted on this boom. With the smaller boom contracted and drawn back adjacent the turntable, the smaller boom minimally effects the weight distribution in the vehicle. When it is desired to use the hydro-hammer instead of the bucket, the big boom may be collapsed and retracted against the turntable, and the other boom extended, to place the hammer at the tip thereof at approximately the same location as formerly occupied by the bucket. The operator's visibility of the hammer is again substantially unobstructed. When working with either the boom 30, or boom 32, the operator occupies the same station in the cab and manipulates controls provides in the control region of the cab.

The mounting for boom 32 utilizes the same reinforced region of the frame employed by the mounting of the larger boom 30.

Should it be desired to remove a boom, such as smaller boom 32, such is readily performed by removing pin 80 which frees the bottom end of the base section 52 in boom 32. The pin may then be returned to provide a mounting for the bottom end of boom 30. The removal of pin 98 and disconnection of hydraulic lines connecting with ram 100 completely frees the boom.

While a particular embodiment of the invention has been described, it should be obvious that modifications and variations are possible without departing from the invention.

It is claimed and desired to secure by Letters Patent:

1. A mobile earth-working vehicle comprising:

a vehicle frame and ground-travelling means supporting the vehicle frame for movement over the ground, a turntable including a turntable frame disposed over said vehicle frame and means rotatably mounting the turntable on said vehicle frame with the turntable rotatable about an upright axis, a pair of articulated booms, each including a tip section and a base section and the base section of each boom having a bottom end and an opposite end, boom mounting means pivotally mounting the bottom end of the base sections in said booms on said turntable frame with the two booms disposed side by side and the base sections of the booms constrained by said mounting means to pivotal movement in parallel vertically disposed planes, said boom mounting means comprising a pair of upstanding laterally spaced and opposed plates secured to the turntable frame, pin means spanning said plates and mounted thereon pivotally supporting the bottom end of the base section of one boom, a third upstanding plate laterally spaced to one side of said pair of plates secured to the turntable frame, and pin means spanning said third plate and the plate of said pair of plates adjacent said third plate pivotally supporting the bottom end of the base section of the other boom, the tip section of each boom being pivotally mounted at one end on the opposite end of the base section in the boom for pivotal movement in the plane in which the base section of the boom is moveable, and an operator's station mounted on said turntable disposed laterally of the planes in which the base sections of the booms move.

2. A mobile earth-working vehicle comprising:

a vehicle frame and ground-travelling means supporting the vehicle frame for movement over the ground, a turntable disposed over said frame and a mounting for the turntable rotatably supporting the turntable on said frame with the turntable being rotatable about an upright axis, said turntable including an elongate turntable frame, first, second and third upstanding and substantially parallel mounting plates disposed with the second plate laterally in one direction to one side of the first, and the third plate laterally in the same direction to one side of the second plate, said plates being fixed to the frame of the turntable and substantially paralleling the longitudinal axis of the turntable, a first articulated boom including a tip section and a base section and the base section having a bottom end and an opposite end, first pivot means pivotally mounting the bottom end of the base section of the first boom supported on said first and second plates with the boom being pivotable about a horizontal axis extending transversely of said plates, a second articulated boom including a tip section and a base section and the base section having a bottom end and an opposite end, second pivot means pivotally mounting the bottom end of the base section of the second bottom on said second and third plates with the boom being pivotable about a horizontal axis extending transversely of said plates, the tip sections of the booms being pivotally mounted at one end to the opposite ends of the base sections in the booms for pivotal movement in the planes in which the base sections of the booms are moveable.

3. The mobile earth-working vehicle of claim 2, which further includes an operator's station, said operator's station being mounted on said turntable frame adjacent an end and on one side of the turntable, said first, second and third mounting plates being mounted on the turntable frame adjacent the same end of the frame and adjacent the opposite side of the frame.

* * * * *